United States Patent [19]

Abseck

[11] Patent Number: 4,483,086

[45] Date of Patent: Nov. 20, 1984

[54] SCROLLING DISPLAY DEVICE FOR FAN-FOLDED PRINTOUT PAPER

[76] Inventor: Stuart Abseck, Box 186, Roxbury, Conn. 06783

[21] Appl. No.: 397,107

[22] Filed: Jul. 12, 1982

[51] Int. Cl.[3] ..... B41J 11/38

[52] U.S. Cl. ..... 40/345; 40/342; 40/343

[58] Field of Search ..... 40/343, 341, 345, 352, 40/342; 226/89; 493/410, 409, 412; 400/619, 642, 646; 116/240

[56] References Cited

U.S. PATENT DOCUMENTS

| | | | |
|---|---|---|---|
| 504,414 | 9/1893 | Crane | 40/345 |
| 1,808,942 | 6/1931 | Allen | 40/341 |
| 2,000,641 | 5/1935 | Jensen | 400/619 |
| 2,102,431 | 12/1937 | McNamara | 40/341 |
| 2,166,508 | 7/1939 | Shipley | 226/195 |
| 2,216,334 | 10/1940 | Akin | 40/345 |
| 2,530,702 | 11/1950 | Johnson | 400/718.1 |
| 2,737,156 | 3/1956 | Denver | 40/343 |
| 2,747,547 | 5/1956 | Drasher | 226/195 |
| 2,803,217 | 8/1957 | Hudak | 40/345 |
| 3,030,923 | 4/1962 | Abseck | 40/343 |
| 3,307,762 | 3/1967 | Boughrum et al. | 226/89 |
| 4,107,700 | 8/1978 | Jornod | 346/76 R |
| 4,226,410 | 10/1980 | McIntosh | 493/410 |

FOREIGN PATENT DOCUMENTS 249646 8/1948 France .

*Primary Examiner*—Robert P. Swiatek
*Assistant Examiner*—Cary E. Stone
*Attorney, Agent, or Firm*—Mattern, Ware, Stoltz & Fressola

[57] ABSTRACT

A scrolling display device for fan-folded printout paper has a housing with two upstanding sides, an internal paper shelf overlying a paper storage bin, a slanting easel display plane panel pivotally mounted at the forward edge of the shelf with idler rollers along its upper edge and idler pinch rolls supported by its rear face; a capstan roller driven by a variable speed reversible drive engages the idler pinch rolls to advance the up-folded sheet drawn from the storage bin up and over the panel to descend behind the panel for re-fan-folded storage on the shelf.

11 Claims, 13 Drawing Figures

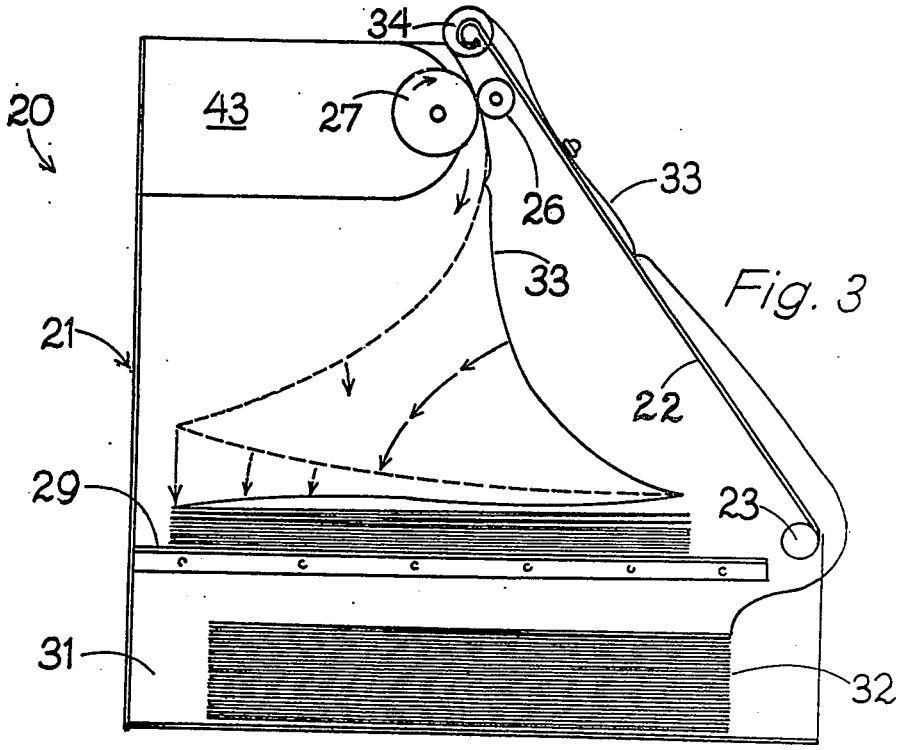
Fig. 3
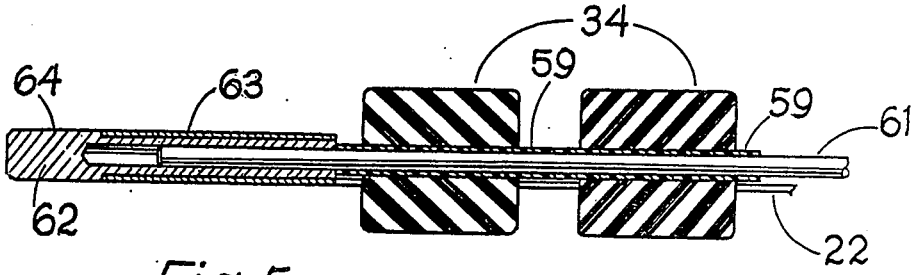
Fig. 5
Fig. 6
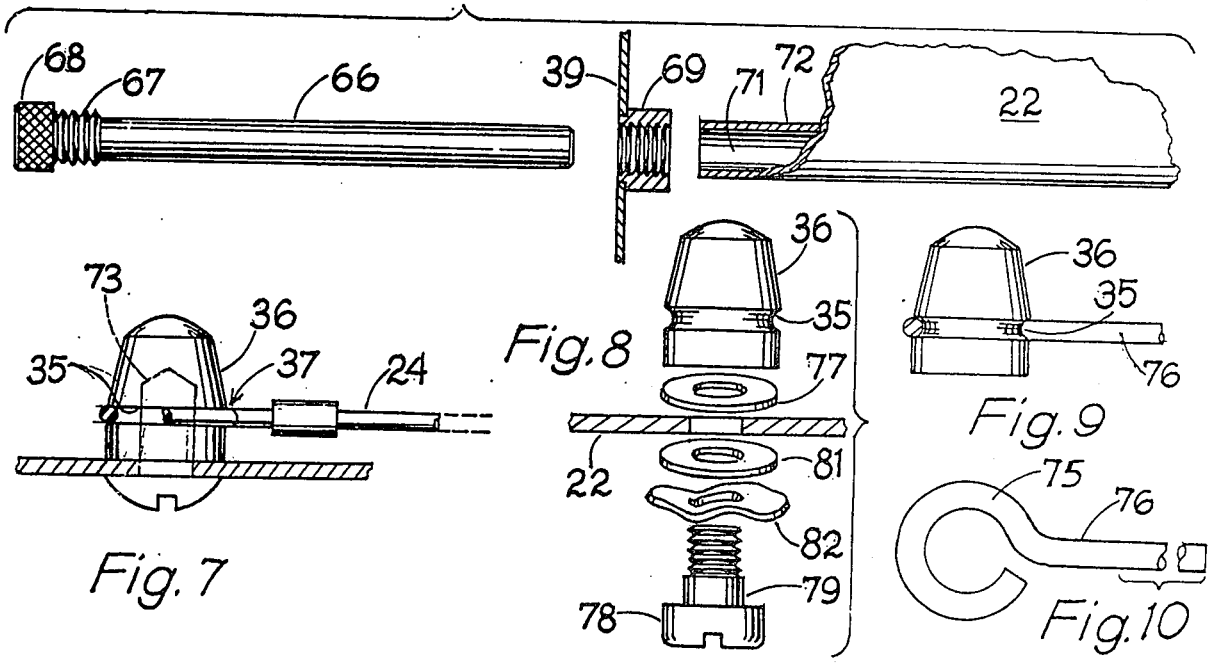
Fig. 7
Fig. 8
Fig. 9
Fig. 10

SCROLLING DISPLAY DEVICE FOR FAN-FOLDED PRINTOUT PAPER

FIELD OF THE INVENTION

This invention relates to scrolling display units for indicia-bearing webs, and particularly to automatic display devices for fan-folded data printout paper.

SUMMARY OF THE INVENTION

The fan-folded paper display devices of this invention provides easily variable speed and even short-run reversing capability. They provide the reading slant display plane, readily down-pivoted for easy loading and unloading of paper stacks as in my Transmatic products, combined with a unique self-guiding web drive transport system. Speed control is easily changed while automatic forward web movement may be started and stopped at will by hand or foot pedal control.

Storage of up to 800 fan folds is provided, and the web may be opened and readily loaded at any fold along its length, for instantaneous feeding advance without threading, sprocketing or adjustment.

Scrolling display velocity is easily changed to suit the user's convenience, and brief reverse travel is readily achieved.

The rigid flat display plane provides an excellent support surface underlying the web for jotting notes beside any data entry, while the normally horizontal line guides overlie the paper web for convenient scanning of horizontal lines of data.

BACKGROUND ART

Fan-folded computer printout paper is being imprinted in large and increasing volumes as computer operations displace conventional techniques in manufacturing, business, government, the courts, and professional offices of all kinds. Review, comparison and restudy of many successive data entries require manual paging of many folds of these fan folded printouts, distracting and tiring the skilled personnel whose alert attention should be devoted to the data alone, and not to the manipulation of the fan folded "pages" on which it is displayed.

As stenographers using abbreviated "shorthand" have switched to note transcribing machines like the "Stenotype" machines utilizing narrow webs of fan-folded paper, display devices have been manufactured, such as my "Transmatic Note Mover" devices. U.S. Pat. Nos. 3,030,923; 2,747,547; 2,737,156; and 2,216,334 all disclose various fan-folded web display devices.

My "Transmatic Note Mover" units provide the convenient advantage of a pivoted, hinged display plane or easel panel customarily upstanding aslant at a convenient display angle, over which the fan-folded web is drawn by foot-switch controlled motor-driven pinch rolls, and which can be readily pivoted forward and downward for removal and insertion of fresh stacks of fan-folded web.

The much greater width of computer printout paper introduces skewing feed problems, and the need for data review at different speeds ranging from high "skimming" speeds to very slow "study" speeds, make a single-speed drive virtually useless.

OBJECTS OF THE INVENTION

Accordingly a principal object of the invention is to provide a convenient and economical display device for wide fan-folded computer printout paper, easily loaded and unloaded for scrolling forward display starting at any fold of the paper stack.

Another object of the invention is to provide such a display device offering self-guided paper transport between a rigid display panel and one or more overlying line guides.

A further object of the invention is to provide such a display device capable of scrolling paper advance at variable speeds with easy starting, stopping and reversing capability.

Another object of the invention is to provide such a display device with a reliable low-friction paper drive assembly affording smooth effortless self-guided paper advance.

Other objects of the invention will in part be obvious and will in part appear hereinafter.

The invention accordingly comprises the features of construction, combinations of elements, and arrangements of parts which will be exemplified in the constructions hereinafter set forth, and the scope of the invention will be indicated in the claims.

For a fuller understanding of the nature and objects of the invention, reference should be had to the following detailed description taken in connection with the accompanying drawings.

BRIEF DESCRIPTION OF THE DRAWINGS

FIG. 3 is a cross-sectional vertical end elevation view showing a fan-folded paper stack already partially displayed, shown as it progresses in forward advancing display motion through the display device;

FIG. 5 is a corresponding enlarged fragmentary cross-sectional top plan view of the upper corner of the display plane panel, showing the details of the idler roller shaft assembly;

FIG. 6 is an enlarged fragmentary exploded view of the lower corner of the display plane panel and its pivot assembly;

FIG. 7 is an enlarged fragmentary bottom cross-sectional view of the edge of the display plane panel, showing an assembled edge guide anchor;

FIG. 8 is a corresponding enlarged and exploded view of a different form of the edge guide anchor of FIG. 7, capable of being rotated;

FIG. 9 is a corresponding enlarged fragmentary bottom view of the edge guide anchor post of FIG. 8 with a rigid guide rod mounted therein;

FIG. 10 is a corresponding enlarged fragmentary front view of the end of the guide rod of FIG. 9, showing the eye loop formed therein;

BEST MODE FOR CARRYING OUT THE INVENTION

Figure 1:
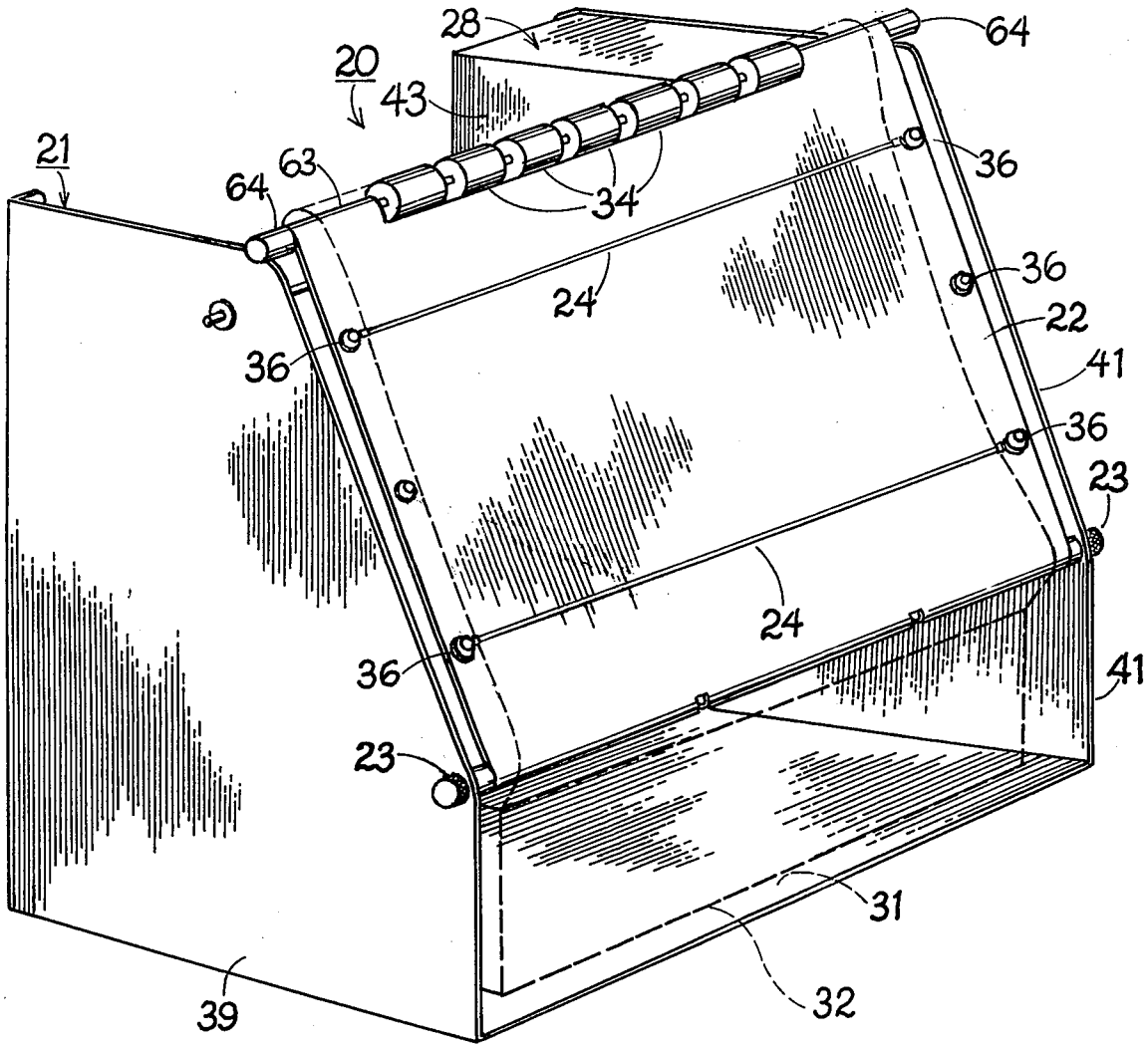
FIG. 1 is a perspective view of a fan-folded paper display device of the present invention.
Figure 2:
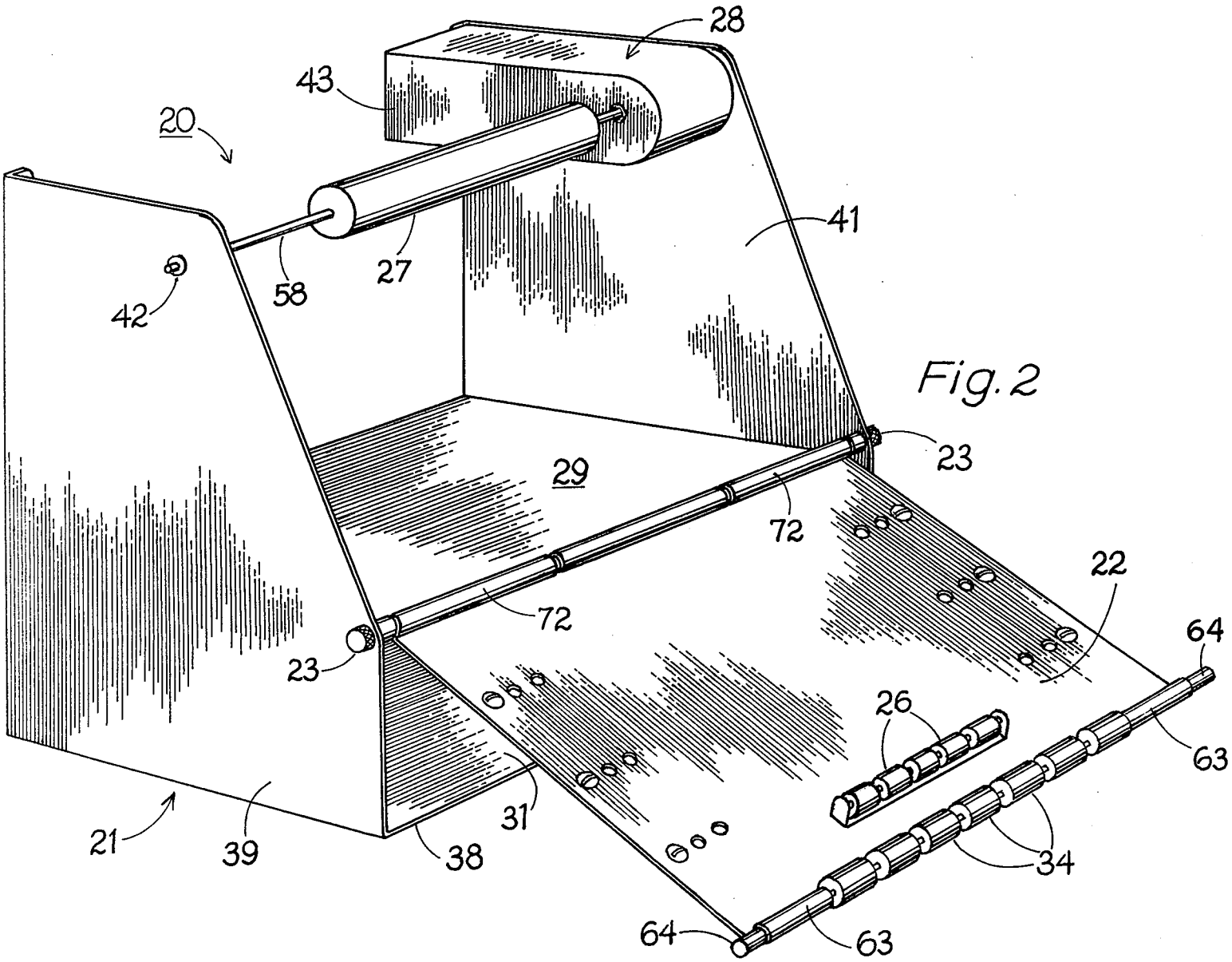
FIG. 2 is a corresponding perspective view of the same device showing its display plane panel pivoted down for convenient loading of a paper stack.

The fan-folded paper display unit 20 shown in FIGS. 1, 2, and 3 comprises a main housing 21, and a pivoting display plane panel 22 joined to the housing at its lower corners by pivot assemblies 23 and provided with one or more line guides 24. A group of idler pinch rolls 26 rotatably mounted on the rear side of the display plane panel 22 are positioned for juxtaposition with a driven capstan pinch roller 27 powered by a variable speed, reversible drive assembly 28. An internal shelf 29 spans the width of the main housing, overlying a large loading bin 31.

As shown in FIG. 3, a fan-folded stack of paper 32 is positioned in bin 31 and has its topmost fold withdrawn from the open front of bin 31 and drawn upwardly before the front face of the display plane panel 22. This displayed fan-folded sheet 33 of paper withdrawn from the stack 32 is then folded rearwardly around a group of idler rollers 34, rotatably mounted along the upper edge of the display plane panel 22.

This loading operation is performed most easily when panel 22 is pivotally swung forward and down in front of housing 21, about two co-axial hinge barrels 72, as shown in FIG. 2. With the paper sheet 32 folded over idler rollers 34, the plane 22 is then pivoted upward and rearward, sandwiching the paper sheet 32 between idler pinch rolls 26 and driven capstan pinch roller 27, as shown in FIG. 3.

While the leading edge of paper sheet 33 coming from the top of the fan-folded stack 32 in bin 31 may be led upward and folded toward the rear, over idler rollers 34, to be inserted between pinch rolls 26 and 27 without moving display plane panel 22 from its normal position shown in FIG. 1, the simplest way to load the paper sheet 33 is by taking advantage of the downward pivoting deployment of panel 22 to the position shown in FIG. 2. In addition, this down-folded position of the pivoting panel 22 permits the stack 32 of fan-folded paper to be divided at any point throughout its height, with its lower portion inserted in bin 31 and its upper portion inserted on shelf 29, with the intervening paper sheet 33 passing over the idler rollers 34 and through the pinch roll drive system of the device. When panel 22 is swung upward to its normal display position shown in FIG. 1, the paper sheet is automatically ready for display, starting at the intermediate point chosen, thus subdividing the stack for instant scrolling display.

To assure the smooth gliding advance of sheet 33, a line guide 24 formed of flexible elastic material with eyelets or end loops 37 is mounted on anchor posts 36. By positioning its end loops or eyelets 37 over the pair of anchor posts 36 as indicated in FIG. 12, line guide 24 is stretched to the anchored position illustrated in FIGS. 1 and 7, where it extends across the exposed face of paper sheet 33, providing a straight visual guide identifying all aligned data entries imprinted across the sheet.

Figure 12:
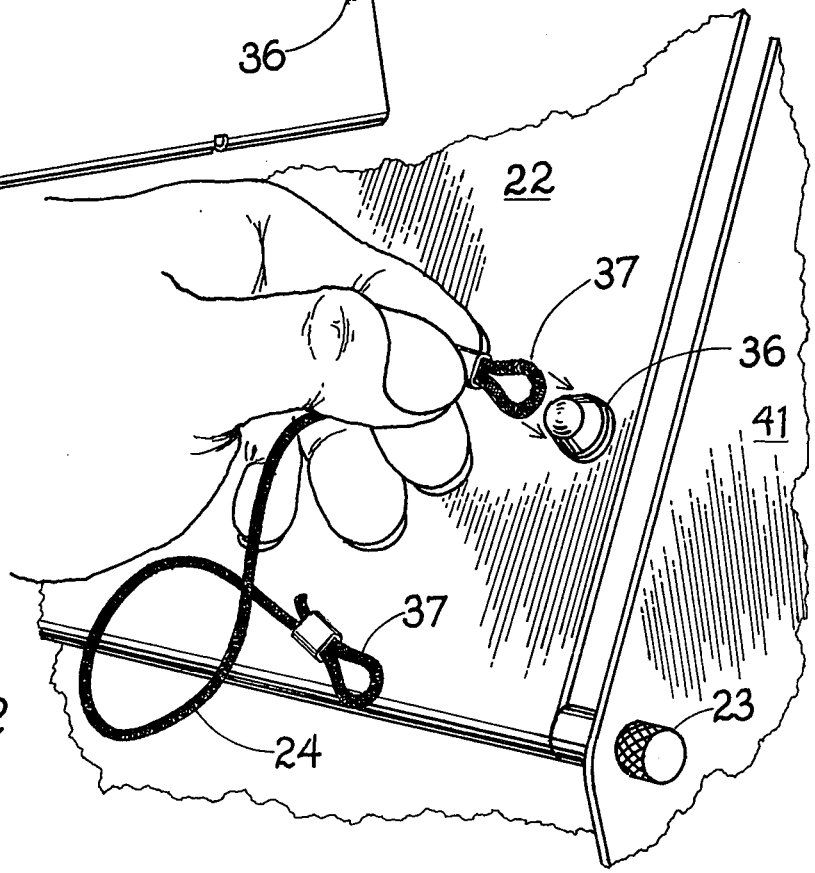
FIG. 12 is a diagrammatic view of an elastic line guide of FIG. 7 in the process of being mounted on a guide anchor post.

As shown in FIG. 12, the eyelets are easily detached and remounted on the anchor posts. When reloading bin 31, for example, the left eyelet may be removed, releasing the elastic line guide 24 to hang from the right hand anchor post. When the paper has been installed in bin 31 and shelf 29, and panel 22 is again in the display position shown in FIG. 1, the line guide 24 is easily reattached across the outer exposed face of the paper by snapping the detached eyelet over the selected anchor post.

While it is possible to stretch line guide 24 between anchor posts at different heights from the lower edge of panel 22, to provide a diagonal paper guide or a crossed X paper guide, the customary position for the elastic line guide 24 will be horizontal, stretched between pairs of anchor posts at the same level, normally the upper or mid levels indicated in the drawings.

As best shown in FIG. 2, rows of holes are provided along both side edges of panel 22 for the mounting of anchor posts 36, at three different heights along these edges. In addition, if desired, as shown in FIG. 2, a plurality of holes may be formed in panel 22 at each height level, permitting various widths of fan-folded paper to be guided through the device with the posts positioned closely beside the paper edges.

Alternatively the display unit 20 can be produced in different widths, sized to accommodate the different standard widths of fan-folded paper, ranging from $8\frac{1}{2}''$ wide to $14\frac{7}{8}''$ wide. The housing 21 is essentially a U-shaped structure having a floor 38 with two upturned side walls 39 and 41. The left side wall 39 is provided with a removable bearing bushing 42 positioned for journalled support of the left end of the driven capstan roller shaft 58 carrying roller 27. Near the forward edge of shelf 29, left side wall 39 is also provided with an aperture accommodating the left pivot assembly 23 supporting the lower edge of the panel 22. Right side wall 41 has mounted on it the drive assembly 28 and the right hand pivot assembly 23.

Figure 4:
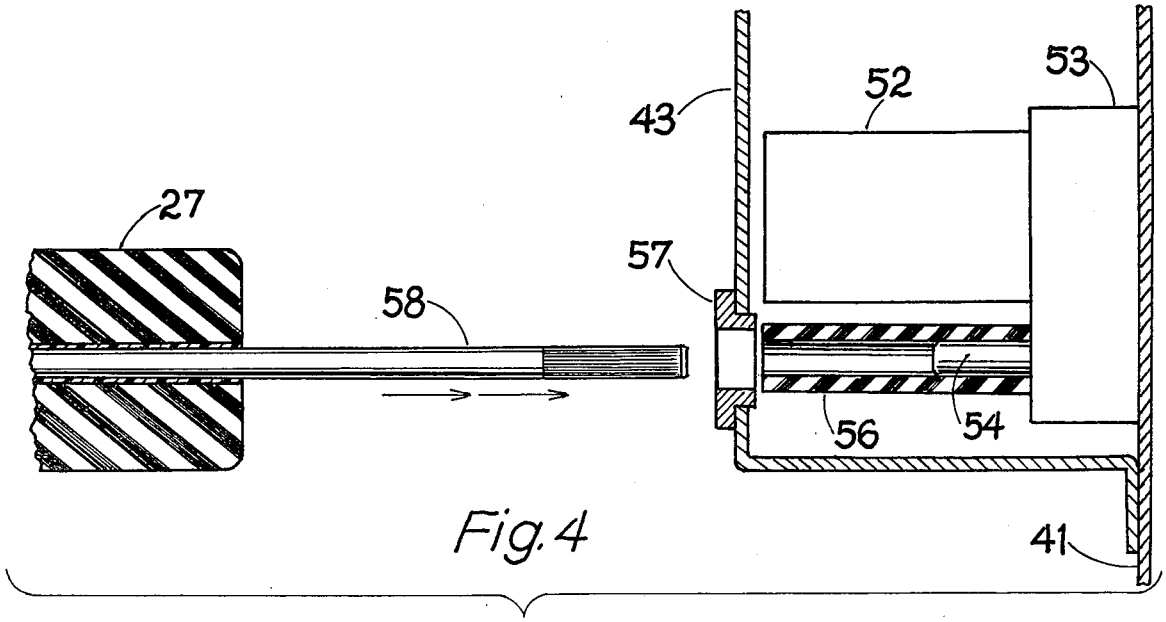
FIG. 4 is an enlarged fragmentary cross-sectional front elevation view showing the pinch roll capstan shaft disassembled and ready for insertion into the flexible coupling joining it to the motor speed reducer shaft.

Shelf 29 spans the space between side walls 39 and 41. By making the floor 38 and the shelf 29 shorter in width from side to side, the side walls 39 and 41 will be closer together and a narrower panel 22 can be accommodated between the pivot assemblies 23, thereby producing a version of the display unit 20 sized to accommodate a narrower width of fan-folded paper sheet. a drive assembly 28 mounted in a drive casing 43 protrudes inward from the right side wall 41 as shown in FIGS. 2 and 4.

Figure 13:
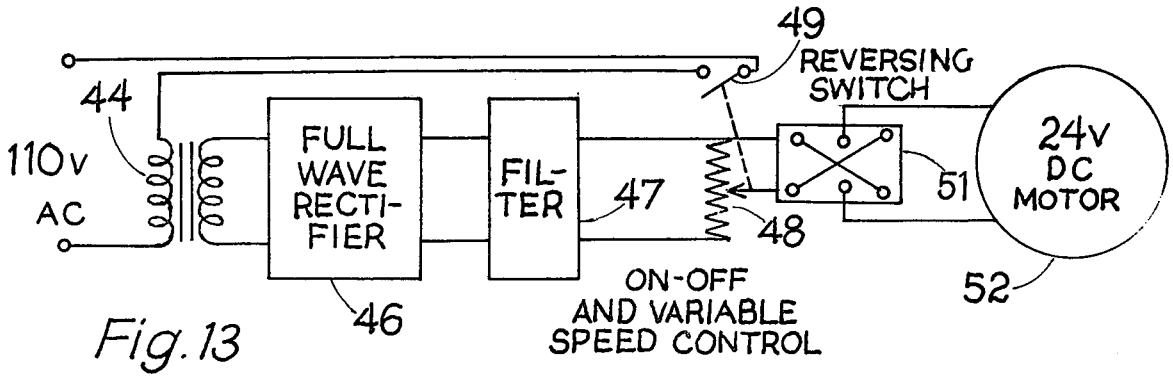
FIG. 13 is a schematic diagram of the electrical drive system control circuitry governing the capstan pinch roll paper transport system of the device.

FIG. 13 is a schematic diagram of electrical drive system circuitry enclosed within the drive casing 43, and including a step down transformer 44 whose secondary winding is connected to a full wave rectifier 46, delivering its output through a filter 47 to a variable speed control rheostat 48, whose movable contact is gauged to an on-off switch 49 interposed on the primary side of transformer 44. The output of the speed control potentiometer 48 is delivered through a reversing switch 51 to a 24 volt DC motor 52 illustrated in FIG. 4 driving a speed reducer 53, and the output shaft 54 of speed reducer 53 is embraced in tractive engagement within the bore of a flexible coupling sleeve 56, formed of a short length of rubber tubing. Sleeve 56 protrudes beyond the end of shaft 54 toward an enlarged bushing 57, aperture mounted in drive casing 43, through which the proximal end of capstan drive roller shaft 58 telescopingly extends into tractive engagement with the central bore of the flexible coupling sleeve 56, as indicated in FIG. 4. In the exploded view of FIG. 4 the shaft 58 is shown ready for insertion through bushing 57 into the open end of coupling sleeve 56, by longitudinal movement to the right. While bushing 57 is oversized, with its inner diameter greater than the outer diameter of shaft 58, it provides a radial support for shaft 58, assuring that capstan drive roller 27 will be presented in tractive driving engagement, sandwiching sheet 33 between itself and idler pinch rolls 26. The flexible sleeve coupling 56 avoids undue strain on the mechanism of the speed reducer 53, and minimizes bending loads on shaft 58 while assuring tractive driving engagement of the capstan roller 27.

Bearing bushing 42 journalling the left end of shaft 58 may have a simple force fit in a punched aperture for the formed in left side wall 39, but preferably the outer periphery of bearing bushing 42 is provided with an external head and fine threads engaging mating threads tapped in the aperture formed in the sidwall 39. By this means the bearing bushing 42 is enabled to stabilize shaft 58, and assure tractive engagement of capstan drive roller 27 with pinch rolls 26 throughout their juxtaposed lengths. If desired the plurality of pinch rolls 26 may be formed as a single long roller.

The idler rollers 34 shown in FIGS. 1, 2, and 3, rotatably mounted along the uppermost edge of panel 22, are preferably formed of solid rubber, and concentrically mounted on thin walled cylindrical plastic sleeves 59 extending a short distance beyond the outer end wall of each roller 34. As shown in FIG. 5, the sleeves 59 accommodate an idler shaft 61 telescopingly installed through the successively aligned sleeves 59, and the ends of shaft 61 are received in a center bore of an elongated shouldered bushing 62, frictionally embraced in interfering engagement inside a bushing chamber formed within the rolled corner end flange 63 formed at the upper end of each side edge of panel 22. Each shoulder bushing 62 is formed with a protruding outer end 64 extending beyond the edge of panel 22 and forming a laterally extending knob or handle facilitating the forward downpivoting movement of panel 22, as shown in FIGS. 1 and 2.

PIVOT ASSEMBLIES

Each of the pivot assemblies 23 illustrated in FIGS. 1, 2, and 6 comprise a headed pivot rod 66 having a reduced diameter over a major part of its length, terminating in an enlarged thread 67 and a radially extending knurled head 68, dimensioned for telescoping engagement through a threaded bushing 69 which is fitted in a punched aperture in the lower front portion of the side walls 39 and 41, with the unthreaded pivot rod portion 66 extending therethrough into a pivot chamber 71 formed by a rolled barrel flange 72 at the lower edge of panel 22, all as shown in FIG. 6. By this means, each telescoping pivot rod 66 provides pivoting support for panel 22 at each of its lower corners, the threads 67 engage the threaded bore in bushing 69, and the knurled head 68 may be torqued to bring its shoulder flush with the outer end of bushing 69.

The reverse unthreading motion of each knurled head 68 withdraws each rod 66 toward the disassembled position shown in FIG. 6, releasing panel 22 from its pivoting engagement with the remainder of the display unit 20 and allowing it to be laid on shelf 29 for convenient shipping.

PAPER GUIDES AND ANCHOR POSTS

The elastic cord line guides 24, shown in FIGS. 1 and 12 are easily installed by slipping their eyelet ends 37 directly over the outer ends of anchor posts 36, rolling the eyelet ends 37 downward along the length of the post 36 until it drops into a recessed groove 35 formed in the outer periphery of each post 36 near its base. As indicated in FIGS. 7 and 8, the base of each post 36 is provided with a threaded axial bore 73 which may be aligned with one of the line guide apertures arrayed along each side edge of panel 22, for alignment with a screw 78 inserted through the aperture into threaded engagement with the threaded bore 73 inside anchor post 36. It may be noted that the pluralities of apertures shown in FIG. 2 allow the guide posts 36 to be positioned at any desired lateral spacing. When six guide posts are installed on panel 22, shown in FIG. 1, one, two, or all three pairs of posts 36 may be connected by an elastic line guide cord 24 overlying the exposed face of panel 22 in spaced relationship, to provide line indications for data printed on the passing sheet 33. Detachment of eyelet 37 from groove 35 is easily accomplished by a gentle outward pull on eyelet 37, this being opposite to the installation motion indicated in FIG. 12.

Figure 11:
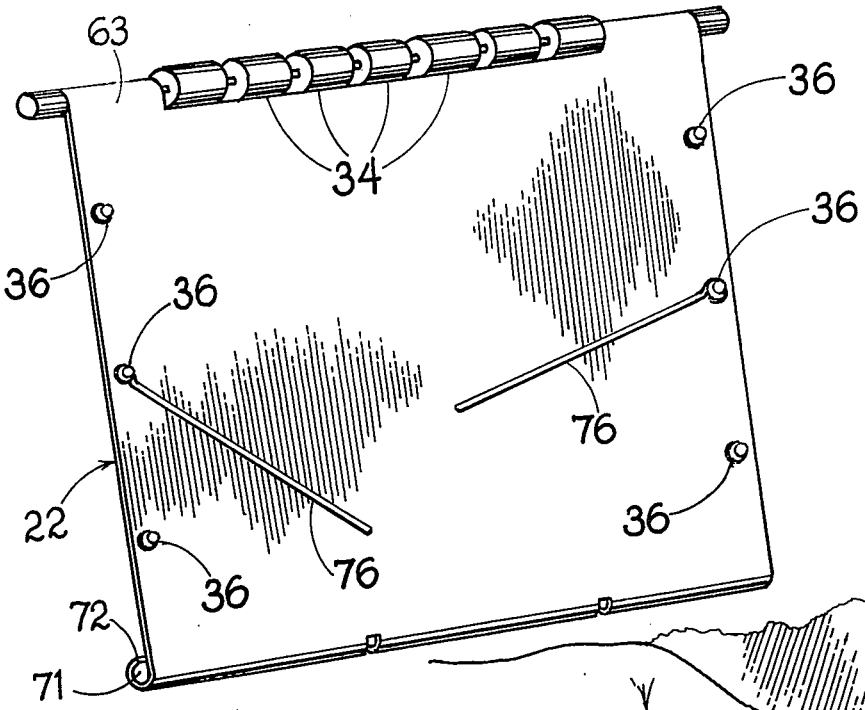
FIG. 11 is a front perspective view of a modified display plane panel with the edge guide rods of FIGS. 9 and 10 installed thereon.

The pivoted guide rods 76, illustrated in FIGS. 9, 10, and 11 are similarly mounted with a terminal eye 75 wedged onto post 36 until it drops into groove 35. There it is held in interfering engagement since the minimal external diameter of the base of groove 35 exceeds the relaxed internal diameter of eye 75, thus holding rod 76 in any desired adjusted angular position, as suggested in FIG. 11.

To allow rods 76 to be pivoted angularly into adjusted positions, the swiveling anchor post assembly shown in FIG. 8 may be employed if desired. The same anchor post 36 is here utilized with a low friction "Teflon" washer 77 positioned between post 36 and panel 22. A shouldered screw 78 is provided with an enlarged shank portion 79 allowing complete threaded installation of the smaller threaded end of shouldered screw 78 inside the threaded bore 73 of post 36, with the unthreaded shank portion 79 passing through the central hole of the "Teflon" washer 77. Sandwiched between the head of screw 78 and the back side of panel 22 opposite to post 36 is a conventional washer 81 and a wavy spring washer 82, with the height of unthreaded shank portion 79 being chosen to provide slight compression for wavy spring washer 82, applying friction tending to hold the pivoting anchor post 36 in any set position, but leaving the anchor post 36 free to swivel on its low friction "Teflon" washer 77 when torque is applied to it by manipulation of a rod 76 seated on its groove 35.

The fan-folded paper transport system achieved by the present invention thus provides variable speed scrolling display of up to 800 folds of fan-folded data printout paper. Display can begin at the beginning, or at any selected fold in the stack. Back spacing and start-stop switching facilitates re-checking and prolonged study of data.

The inclined display plane panel 22 minimizes eyestrain and fatigue, while its pivoting construction provides easy loading capability.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

I claim:

1. A display device for a fan-folded indicia-bearing web of paper or like material comprising a paper stack storage housing incorporating two upstanding sides surmounting a supporting base means, paper stack-supporting shelf means spanning the space between the two upstanding sides, spaced above the supporting base means to overlie a paper stack storage bin beneath the shelf means, pivot means mounted close to the front of each side near the level of the shelf means, an easel display plane panel having its lower end portion pivotally mounted on the pivot means for angular pivoting movement between a forward and downwardly extending loading position and an upward and rearwardly inclined display position presenting an elongated easel display plane for supporting a substantial length of the web, idler roller means rotatably mounted on a transverse axis near the upper distal end of the panel, pinch roll means rotatably mounted on and protruding behind the panel near the idler roller means, and driven capstan roller means rotatably mounted spanning the space between the two sides, and presented for tractive engagement with the pinch roll means when the panel is in its upward and rearwardly inclined display position, whereby a stack of fan-folded paper positioned in the storage bin beneath the shelf means may have its topmost fan fold drawn forward and upward in front of the elongated easel display plane panel, thus displaying a substantial length of the web unobscured by any support members, and thence rearward over the idler roller means into sandwiched tractive engagement between the pinch roll means and the driven capstan roller means, to be delivered onto the top surface of the shelf means in a re-fan-folded stack by operation of the capstan roller means, while the paper web remains readily releasable for quick indexing selection of different web portions for display by pivoting the display plane panel to its loading position, avoiding any need for unthreading or un-sprocketing of the web.

2. The display device defined in claim 1, including at least one pair of paper guide posts mounted on and protruding forward from the panel near its side edges, removably positioned for guiding juxtaposition with the edges of the unfolded paper approaching the idler roller means near the top of the panel.

3. The display device defined in claim 1, wherein the pivot means are formed as a pair of pivot rods each removably anchored to one of the sides protruding toward the other side, with the display plane panel being formed with a pair of tubular pivot barrels each positioned for freely rotatable telescoping engagement on one of the protruding pivot rods.

4. The display device defined in claim 1, wherein the idler roller means comprising at least one cylindrical roller mounted for revolution on a co-axial shaft having its ends telescopingly supported in facing bores formed in a pair of handle sleeves mounted on the panel and having outer ends extending outward beyond the panel edge to form handle knobs protruding laterally near the respective upstanding sides of the housing to facilitate convenient pivoting manipulation of the panel between its loading position and its display position.

5. The display device defined in claim 1, wherein the capstan roller is keyed on a co-axial capstan shaft having one end journalled in a removable bushing mounted near the top of one side of the housing, and its other end tractively telescoped inside one end of a tubular flexible elastomer coupling whose other end is similarly telescoped over a substantially co-axial motor-driven drive shaft.

6. The display device defined in claim 5, wherein the drive shaft forms the output shaft of a speed reducer actuated by an electric motor whose speed is selected by adjustment of a potentiometer, and wherein the motor, the speed reducer, and the potentiometer are all contained in an enclosed drive housing mounted inside and near the top of the housing side for engaging the flexible coupling end of the capstan shaft, behind the rearwardly inclined display position of the easel display plane panel, avoiding any substantial exterior protrusions outside the housing.

7. A display device for a fan-folded indicia-bearing web of paper or like material comprising a paper stack storage housing incorporating two upstanding sides surmounting a supporting base means, paper stack-supporting shelf means spanning the space between the two upstanding sides, spaced above the supporting base means to overlie a paper stack storage bin beneath the shelf means, pivot means mounted close to the front of each side near the level of the shelf means, an easel display plane panel having its lower portion pivotally mounted on the pivot means for angular pivoting movement between a forward and downwardly extending loading position and an upward and rearwardly inclined display position, idler roller means rotatably mounted on a transverse axis near the top of the panel, pinch roll means rotatably mounted on and protruding behind the panel near the idler roller means, and driven capstan roller means rotatably mounted spanning the space between the two sides, and presented for tractive engagement with the pinch roll means when the panel is in its display position, with at least one pair of paper guide posts mounted on and protruding forward from the panel near its side edges, positioned for guiding juxtaposition with the edges of the unfolded paper approaching the idler roller means near the top of the panel, and further including an elongated elastic line guide having a terminal eyelet formed at each end for removable engagement on one of the pair of guide posts, whereby one eyelet can be easily removed during paper-loading, leaving the line guide suspended from the other post, available for quick and convenient reinstallation after paper-loading is completed, whereby a stack of fan-folded paper positioned in the storage bin beneath the shelf means may have its topmost fan fold drawn forward and upward in front of the panel between the guide posts, and thence rearward over the idler roller means into sandwiched tractive engagement between the pinch roll means and the driven capstan roller means, to be delivered onto the top surface of the shelf means in a re-fan-folded stack by operation of the capstan roller means.

8. A display device for a fan-folded indicia-bearing web of paper or like material comprising a paper stack storage housing incorporating two upstanding sides surmounting a supporting base means, paper stack-supporting shelf means spanning the space between the two upstanding sides, spaced above the supporting base means to overlie a paper stack storage bin beneath the shelf means, pivot means mounted close to the front of each side near the level of the shelf means, an easel display plane panel having its lower portion pivotally mounted on the pivot means for angular pivoting movement between a forward and downwardly extending loading position and an upward and rearwardly inclined display position, idler roller means rotatably mounted on a transverse axis near the top of the panel, pinch roll means rotatably mounted on and protruding behind the panel near the idler roller means, and driven capstan roller means rotatably mounted spanning the space between the two sides, and presented for tractive engagement with the pinch roll means when the panel is in its display position, with at least one pair of paper guide posts mounted on and protruding forward from the panel near its side edges, positioned for guiding juxtaposition with the edges of the unfolded paper approaching the idler roller means near the top of the panel, each guide post being provided with a central groove encircling its periphery, and a conically tapered upper end above the groove, and further including a rigid elongated guide rod having an open resilient eye loop formed at one end, dimensioned for camming deformation as the loop is forced axially along the conically tapered upper post end, and for firm anchored engagement in the groove with the guide rod extending radially from the post, near and spaced away from the panel to overlie the unfolded paper approaching the idler roller means near the top of the panel, whereby a stack of fan-folded paper positioned in the storage bin beneath the shelf means may have its topmost fan fold drawn forward and upward in front of the panel between the guide posts, and thence rearward over the idler roller means into sandwiched tractive engagement between the pinch roll means and the driven capstan roller means, to be delivered onto the top surface of the shelf means in a re-fan-folded stack by operation of the capstan roller means.

9. The display device defined in claim 8, wherein the guide posts are each mounted on a resiliently biassed screw assembly with a low friction layer interposed between each post and the panel, permitting convenient angular adjustment of the guide rods to any desired angle of inclination.

10. A display device for a fan-folded indicia-bearing web of paper or like material comprising a paper stack storage housing incorporating two upstanding sides surmounting a supporting base means, paper stack-supporting shelf means spanning the space between the two upstanding sides, spaced above the supporting base means to overlie a paper stack storage bin beneath the shelf means, pivot means mounted close to the front of each side near the level of the shelf means, an easel display plane panel having its lower portion pivotally mounted on the pivot means for angular pivoting movement between a forward and downwardly extending loading position and an upward and rearwardly inclined display position, idler roller means rotatably mounted on a transverse axis near the top of the panel, pinch roll means rotatably mounted on and protruding behind the panel near the idler roller means, and driven capstan roller means rotatably mounted spanning the space between the two sides, and presented for tractive engagement with the pinch roll means when the panel is in its display position, the capstan roller means being mounted on a coaxial capstan shaft having one end journalled in a bushing mounted near the top of one side of the housing, and its other end tractively telescoped inside one end of a tubular flexible coupling whose other end is similarly telescoped over a motor-driven shaft which forms the output shaft of a speed reducer actuated by an electric motor whose speed is selected by adjustment of a potentiometer, and wherein the motor, the speed reducer, and the potentiometer are all contained in an enclosed drive housing mounted near the top of the housing side near the flexible coupling end of the capstan shaft, with the flexible coupling being enclosed within the drive housing, and with the capstan shaft extending through an oversized bushing mounted in the drive housing, whereby disassembly of the capstan shaft from the flexible coupling is unimpeded while defections caused by loads transverse to the capstan shaft axis are resisted by the oversized bushing, and the motor and speed reducer mechanism are thereby protected from distortion, and whereby the flexible coupling forms a torque limiter protecting the motor and speed reducer from excessive torque loads.

11. A display device for a fan-folded indicia-bearing web of paper or like material comprising a paper stack storage housing incorporating two upstanding sides surmounting a supporting base means, paper stack-supporting shelf means spanning the space between the two upstanding sides, spaced above the supporting base means to overlie a paper stack storage bin beneath the shelf means, pivot means mounted close to the front of each side near the level of the shelf means, an easel display plane panel having its lower portion pivotally mounted on the pivot means for angular pivoting movement between a forward and downwardly extending loading position and an upward and rearwardly inclined display position, idler roller means rotatably mounted on a transverse axis near the top of the panel, pinch roll means rotatably mounted on and protruding behind the panel near the idler roller means, and driven capstan roller means rotatably mounted spanning the space between the two sides, and presented for tractive engagement with the pinch roll means when the panel is in its display position, the capstan roller means being mounted on a coaxial capstan shaft having one end journalled in a bushing mounted near the top of one side of the housing, and its other end tractively telescoped inside one end of a tubular flexible coupling whose other end is similarly telescoped over a motor-driven drive shaft which forms the output shaft of a speed reducer actuated by an electric motor whose speed is selected by adjustment of a potentiometer, and wherein the motor, the speed reducer, and the potentiometer are all contained in an enclosed drive housing which is mounted near the top of the housing side near the flexible coupling end of the capstan shaft, and shaped with a curved forward end forming with the rear face of the panel a converging passageway down which the unfolded paper sheet is readily inserted when it is being loaded into the display device.

* * * * *